US007319429B2

(12) United States Patent
Chang et al.

(10) Patent No.: US 7,319,429 B2
(45) Date of Patent: Jan. 15, 2008

(54) PARTIALLY REFLECTIVE SURFACE ANTENNA

(75) Inventors: The-Nan Chang, Taipei (TW); Chih-Hsien Chiu, Taipei (TW)

(73) Assignee: Tatung Company, Taipei (TW)

( * ) Notice: Subject to any disclaimer, the term of this patent is extended or adjusted under 35 U.S.C. 154(b) by 44 days.

(21) Appl. No.: 11/322,406

(22) Filed: Jan. 3, 2006

(65) Prior Publication Data

US 2007/0090998 A1 Apr. 26, 2007

(30) Foreign Application Priority Data

Oct. 25, 2005 (TW) ..... 94137287 A

(51) Int. Cl.
*H01Q 1/38* (2006.01)
*H01Q 21/00* (2006.01)

(52) U.S. Cl. ..... 343/700 MS; 343/725; 343/844

(58) Field of Classification Search ..... 343/700 MS, 343/725, 844, 853, 893
See application file for complete search history.

(56) References Cited

U.S. PATENT DOCUMENTS 5,444,453 A * 8/1995 Lalezari ..... 343/700 MS
6,529,166 B2 * 3/2003 Kanamaluru ..... 343/700 MS
7,026,995 B2 * 4/2006 Sreenivas et al. .... 343/700 MS

* cited by examiner

*Primary Examiner*—Shih-Chao Chen
(74) *Attorney, Agent, or Firm*—Bacon & Thomas, PLLC

(57) ABSTRACT

The present invention relates to a partially reflective surface antenna and, more particularly, to a partially reflective surface antenna including a reflective board composed of arrays of microstrip antennas, and has advantages of low side lobe and high gain. It comprises: a substrate with an upper surface having a signal transmitting notch for transmitting and receiving a high frequency signal; a reflective board for partially reflecting the high frequency signal; and a plurality of supporting elements for supporting the reflective board on the substrate. The reflective board has a second antenna array and a first antenna array surrounded by the second antenna array, wherein the first and the second antenna array are composed of a plurality of first microstrip reflective units and a plurality of second microstrip reflective units, respectively. Besides, the distance between the first microstrip reflective units is smaller than the distance between the second microstrip reflective units.

13 Claims, 10 Drawing Sheets

PARTIALLY REFLECTIVE SURFACE ANTENNA

BACKGROUND OF THE INVENTION

1. Field of the Invention

The present invention relates to a partially reflective surface antenna and, more particularly, to a partially reflective surface antenna that includes a reflective board composed of arrays of microstrip antennas, and has the advantages of low side lobe and high gain.

2. Description of Related Art

Recently, in the military or civil application fields, a partially reflective surface antenna having a partially reflective surface (PRS), which is composed of arrays of microstrip antenna, has been used frequently. These partially reflective surface antennas have low profile, and can be manufactured by using printed circuit boards (PCB).

However, the high frequency signals transmitted by these partially reflective surface antennas still have obvious levels of the side lobe portion, and the ratio of the side lobe portion to the whole waveform cannot be further decreased. This drawback prevents the partially reflective surface antenna from providing high frequency signals whose energy is centralized at the portion in the main beam direction, and thus limits the transmission distance of the high frequency signals. Furthermore, the gain of the partially reflective surface antenna cannot be continuously increased as the area of the reflective board increases. Namely, when the area of the reflective board is larger than an optimum value, the efficiency (the gain of a unit area) of the partially reflective surface antenna contrarily decreases as the area of the reflective board increases. Currently, the best available efficiency of the conventional partially reflective surface antenna is only about 50%.

FIG. 1 is a schematic drawing of the conventional partially reflective surface antenna, wherein the partially reflective surface antenna 1 comprises a substrate 11 and a reflective board 12. Both of them are composed of microwave substrates made of the FR-4 materials. The reflective board 12 is supported by the first supporting rod 141, the second supporting rod 142, the third supporting rod 143, and the fourth supporting rod 144. As a result, a resonant distance between the reflective board 12 and the upper surface 111 of the substrate 11 is maintained. The length of the resonant distance is determined with relation to the design frequency of the partially reflective surface antenna 1. Besides, a rectangular notch (not shown) is formed near the center position of the substrate 11, and the rectangular notch is electrically connected to a coaxial cable (not shown) via a rectangular to coaxial adapter to transmit or receive the high frequency signal.

When the partially reflective surface antenna is in the "transmitting state", the high frequency signal is reflected back and forth between the substrate 11 and the reflective board 12. Later, due to the "partially reflection" effect of the reflective board 12, the high frequency signal eventually passes through the reflective board 12 and then the high frequency signal will pass through the reflective board 12 and will be transmitted outwardly by the partially reflective surface antenna 1. The length and width of the reflective board 12 are both 12.9 cm, and a plurality of microstrip reflective units 13 are disposed evenly on the upper surface 121 of the reflective board 12. The length and width of the microstrip reflective units are both 12 mm, and the distance between two adjacent microstrip reflective units is 1.1 mm.

As depicted above, even though the conventional partially reflective surface antenna 1 can properly adjust the arrangement of the microstrip reflective units 13 disposed on the upper surface 121 of the reflective board 12 (i.e. adjust the distance between two adjacent microstrip reflective units 13) to improve the signal to noise ratio (S/N ration) and the directivity of the high frequency signal it transmits. However, the ratio of the side lobe portion of the high frequency signal transmitted by the conventional partially reflective surface antenna 1 cannot be further decreased and the gain of the conventional partially reflective surface antenna 1 cannot be further increased, either.

Therefore, it is desired to have a partially reflective surface antenna being able to provide the advantages of low side lobe portion ratio and high gain, in order to improve the efficiency of antenna module in a wireless communication system.

SUMMARY OF THE INVENTION

The partially reflective surface antenna of the present invention comprises: a substrate with an upper surface having a signal transmitting notch for transmitting and receiving a high frequency signal; a reflective board for partially reflecting the high frequency signal; and a plurality of supporting elements for supporting the reflective board on the upper surface of the substrate and to maintain a specific distance between the reflective board and the substrate. Wherein a first antenna array and a second antenna array are disposed on the surface of the reflective board, and the first antenna array is surrounded by the second antenna array. The first antenna array is composed of a plurality of the first microstrip reflective units, and the second antenna array is composed of a plurality of the second microstrip reflective units, wherein the distance between the first microstrip reflective units is smaller than the distance between the second microstrip reflective units.

Therefore, by having two different kinds of arrangement of the antenna array disposed on the surface of the reflective board, the partially reflective surface antenna of the present invention can reduce the energy ratio of the side lobe portion of the transmitted high frequency signals and centralize the energy of the transmitted high frequency signals into its main lobe portion, in order to elongate the distance that the high frequency signal can be transmitted and minimize the possibility of the high frequency signal suffering interference. Furthermore, the gain of the partially reflective surface antenna of the present invention is raised higher than that of the conventional partially reflective antenna, so the antenna module having the partially reflective surface antenna of the present invention can have optimum operation efficiency.

The material of the printed circuit board which composes the substrate of the partially reflective surface antenna of the present invention is not limited; the substrate is preferably made of a microwave substrate of the FR-4 material, a microwave substrate of the Duroid material, or a microwave substrate of the Teflon material. The material of the printed circuit board which composes the reflective board of the partially reflective surface antenna of the present invention is not limited; the reflective board is preferably made of a microwave substrate of the FR-4 material, a microwave substrate of the Duroid material, or a microwave substrate of the Teflon material. The shape of the reflective board of the partially reflective surface antenna of the present invention is not limited; the shape is preferable square, rectangular, or circular. The shape of the first microstrip reflective units of the partially reflective surface antenna of the present invention is not limited; the shape is preferably square or strip-like. The shape of the second microstrip reflective units of the partially reflective surface antenna of the present invention is not limited; the shape is preferably square or strip-like. The material of the supporting elements of the partially reflective surface antenna of the present invention is not limited; it is preferably made of an insulating material. The frequency range of the high frequency signal transmitted or received by the partially reflective surface antenna of the present invention is not limited; the frequency range is preferably between 8 GHz and 26 GHz. The distance between the reflective board and the substrate of the partially reflective surface antenna of the present invention is not restricted; it is preferably one-third to two-thirds of the wavelength of the high frequency signal, and it is more preferably one-half of the wavelength of the high frequency signal. The form of the signal transmitting notch of the substrate of the partially reflective surface antenna of the present invention is not limited; it is preferably a square notch or a rectangular notch. The form of the signal wire being electrically connected to the signal transmitting notch of the substrate of the partially reflective surface antenna of the present invention is not limited; it is preferably a coaxial cable or a copper wire.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
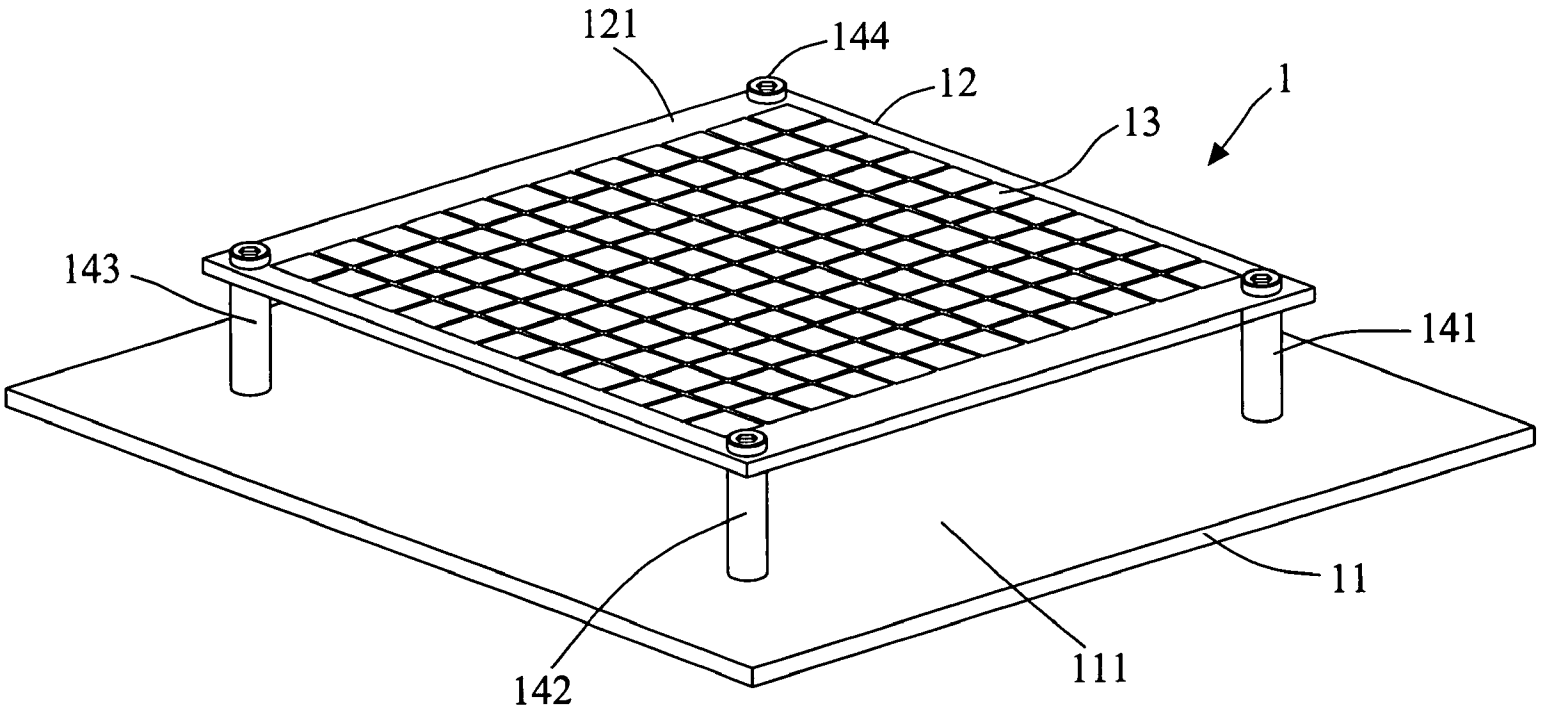
FIG.1 (Prior Art)
FIG. 1 is a schematic drawing of the conventional partially reflective surface antenna.
Figure 2A:
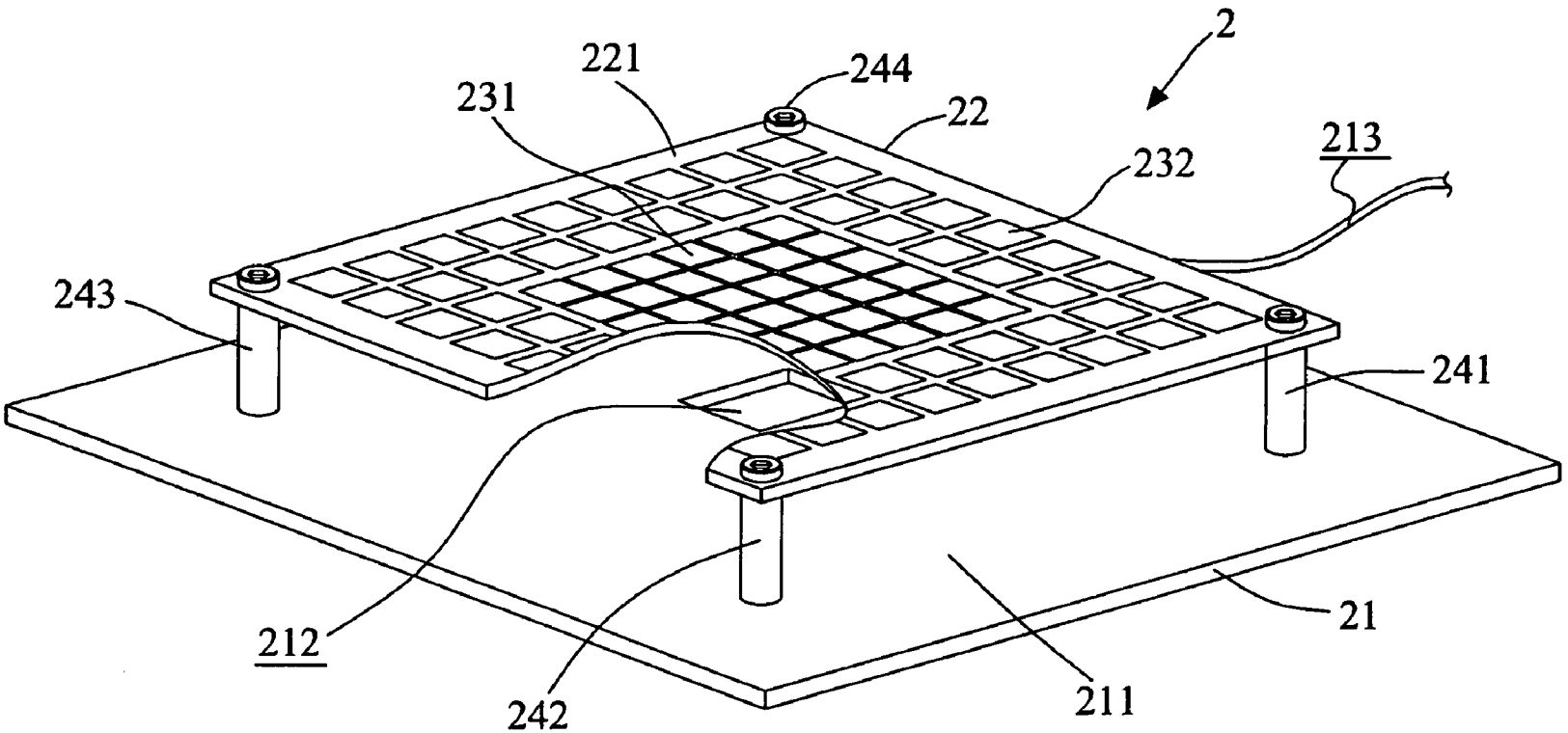
FIG. 2A is a perspective schematic drawing of the partially reflective surface antenna according to the first preferred embodiment of the present invention.

FIG. 2A is a perspective schematic drawing of the partially reflective surface antenna according to the first preferred embodiment of the present invention, wherein the partially reflective surface antenna 2 comprises a substrate 21 and a reflective board 22. Both of them are composed of microwave substrates made of the FR-4 materials with a thickness of 0.8 mm. The reflective board 22 is supported by a first supporting rod 241, a second supporting rod 242, a third supporting rod 243, and a fourth supporting rod 244. As a result, a resonant distance between the reflective board 22 and an upper surface 211 of the substrate 21 is maintained. The length of the resonant distance is determined with relation to the design frequency of the partially reflective surface antenna 2 of the present invention. That is, when the design frequency of the partially reflective surface antenna 2 of the present invention is 9.3 GHz, the resonant distance is about 1.68 cm; and when the design frequency of the partially reflective surface antenna 2 of the present invention is 9.5 GHz, the resonant distance is about 1.65 cm.

Besides, there is a rectangular notch 212 near the center position of the substrate 21, and the rectangular notch 212 is electrically connected to a coaxial cable 213 in order to transmit or receive a high frequency signal the frequency range of which is between 9.25 GHz and 9.55 GHz. When the partially reflective surface antenna of the first preferred embodiment of the present invention is in the "transmitting state", the high frequency signal is reflected back and forth between the substrate 21 and the reflective board 22 of the partially reflective surface antenna 2 of the invention. Later, due to the "partial reflection" effect of the reflective board 22, the high frequency signals eventually pass through the reflective board 22 and will be transmitted outwardly by the partially reflective surface antenna 2.

Figure 2B:
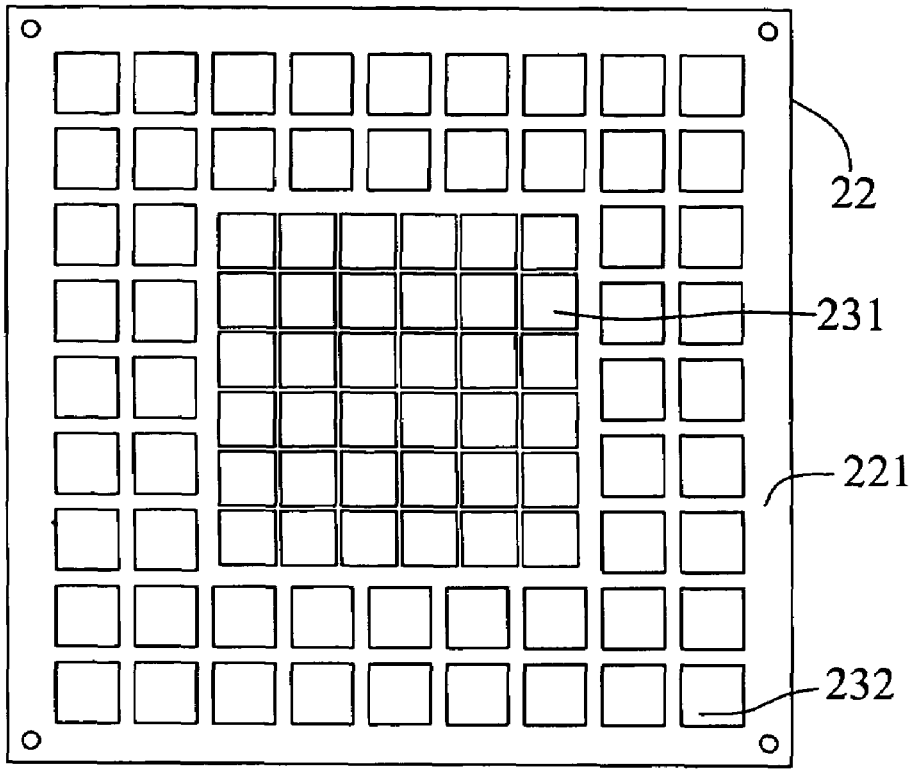
FIG. 2B is a schematic drawing of the reflective board of the partially reflective surface antenna according to the first preferred embodiment of the present invention.
Figure 2C:
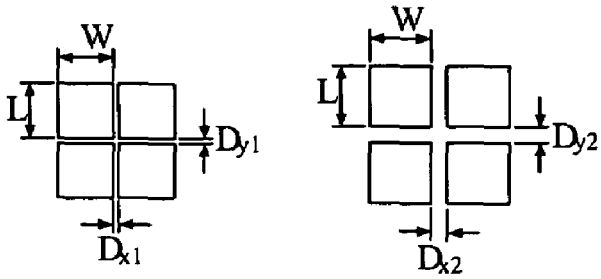
FIG. 2C is a schematic drawing showing the two kinds of the arrangements of the first antenna array and the second antenna array disposed on the surface of the reflective board of the partially reflective surface antenna according to the first preferred embodiment of the present invention.

As shown in FIG. 2B and FIG. 2C, both the length and width of the reflective board 22 are 17.8 cm, and the surface area of the reflective board 22 is 316.94 $cm^2$. There are two kinds of antenna arrays disposed on the upper surface 211 of the reflective board 22, i.e. the first antenna array and the second antenna array, with different pitches. In these two kinds of the antenna arrays, the length (L) and width (W) of the composing first microstrip reflective units 231 and each of the composing second microstrip reflective units 232 are both 12 mm. However, the distance between each of the first microstrip reflective units 231 is different from the distance between each one of the second microstrip reflective units 232. Namely, in the first antenna array, the distances between two adjacent first microstrip reflective units 231 in the X-axis direction (Dx 1) and in the Y-axis direction (Dy1) are both 1.1 mm (Dx1=Dy1=1.1 mm). On the other hand, in the second antenna array, the distances between two adjacent first microstrip reflective units 231 in the X-axis direction (Dx2) and in the Y-axis direction (Dy2) are both 3.14 mm (Dx2=Dy2=3.14 mm).

Figure 3A:
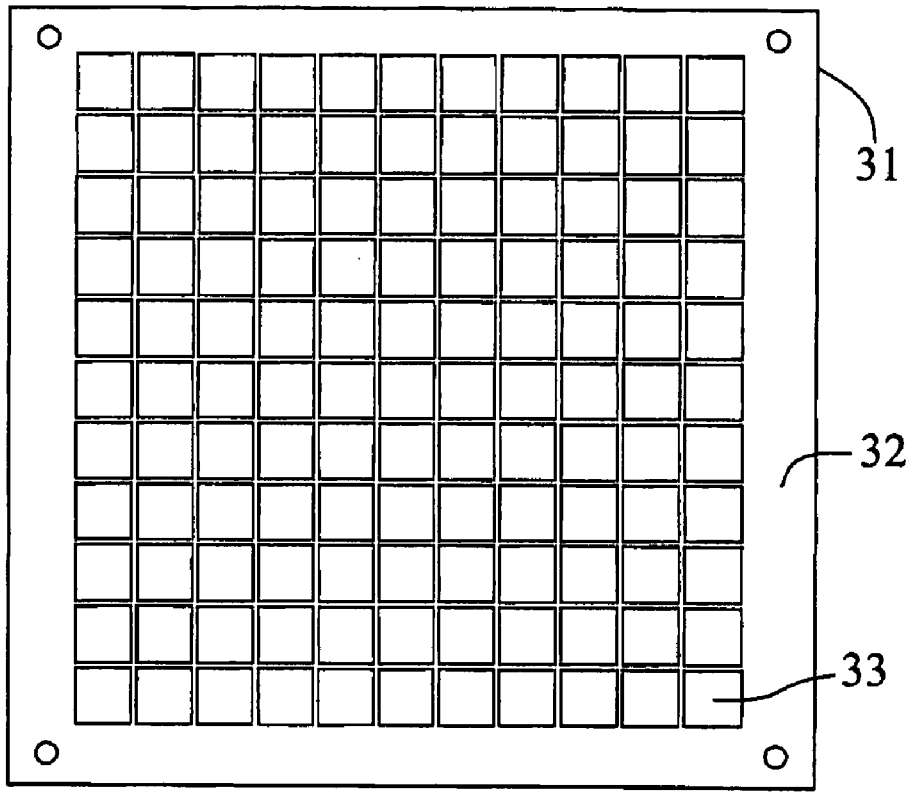
FIG.3A(Prior Art)
FIG. 3A is a schematic drawing of the reflective board of the first kind of the conventional partially reflective surface antenna.
Figure 3B:
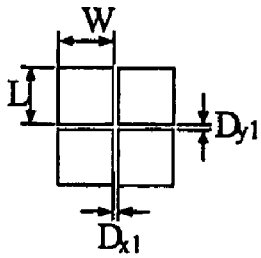
FIG.3B(Prior Art)
FIG. 3B is a schematic drawing showing the arrangement of the microstrip reflective units disposed on the surface of the reflective board displayed in FIG. 3A.

FIG. 3A is a schematic drawing of the reflective board of the first kind of the conventional partially reflective surface antenna, while FIG. 3B is a schematic drawing showing the arrangement of the microstrip reflective unit disposed on the surface of the reflective board displayed in FIG. 3A. The reflective board 31 is composed of a microwave substrate made of the FR-4 materials with a thickness of 0.8 mm. The length and width of the reflective board 31 are both 12.9 cm, and the surface area of the reflective board 31 is 166.41 $cm^2$. There is a plurality of microstrip reflective units 33 evenly disposed on the upper surface 32 of the reflective board 31, while both the length (L) and width (W) of the microstrip reflective unit 33 are 12 mm. The distance between two adjacent microstrip reflective units 33 in the x-axis direction and the y-axis direction are both 1.1 mm (Dx1=Dy1=1.1 mm).

After comparing the features (i.e. side lobe level ratio, gain, etc.) of the high frequency signal transmitted by the first kind of the conventional partially reflective surface antenna to those of the high frequency signal transmitted by the partially reflective surface antenna according to the first preferred embodiment of the invention, it is obvious that the high frequency signal transmitted by the partially reflective surface antenna according to the first preferred embodiment of the invention has lower side lobe level and better gain.

Figure 4A:
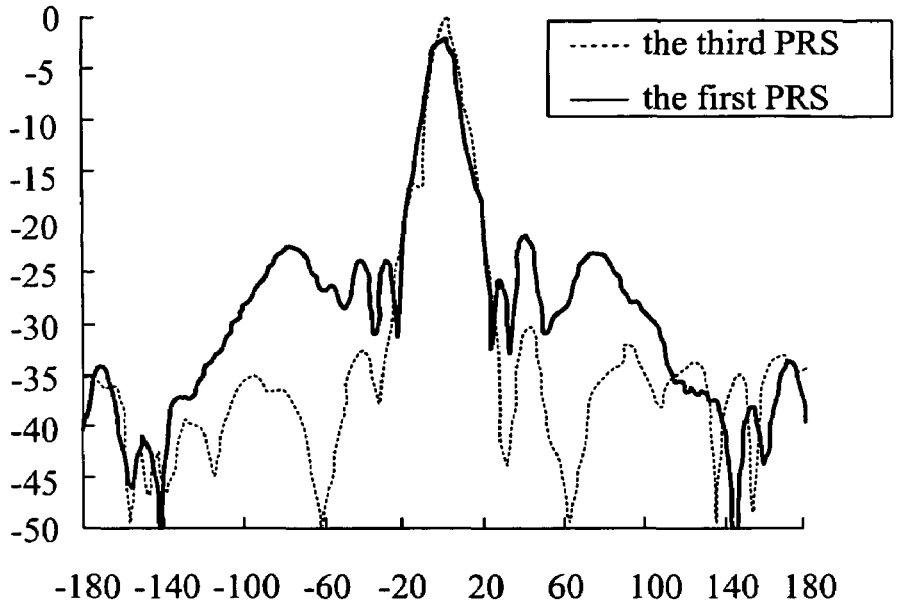
FIG. 4A is a waveform diagram at the magnetic field plane showing the waveforms of the high frequency signals transmitted by the first kind of the conventional partially reflective surface antenna and by the partially reflective surface antenna according to the first preferred embodiment of the present invention.
Figure 4B:
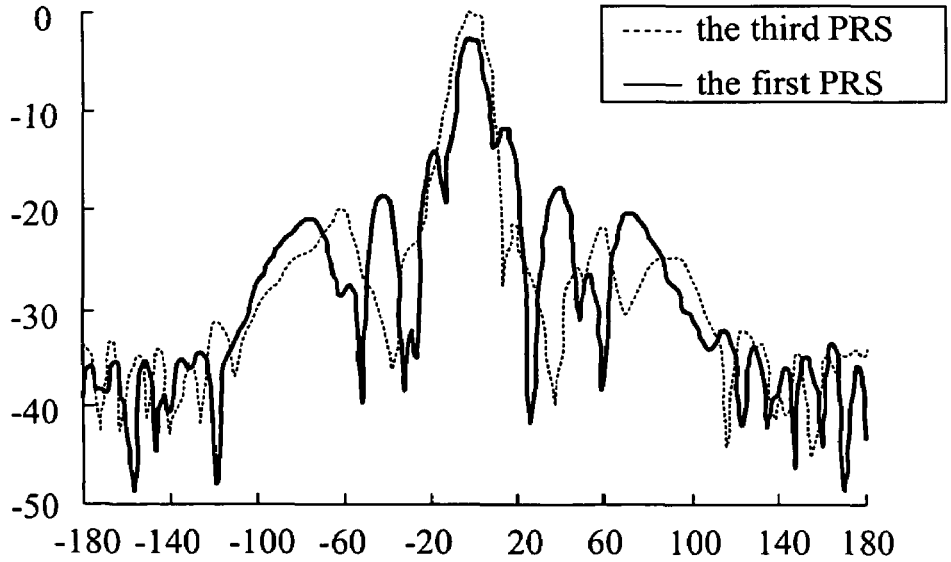
FIG. 4B is a waveform diagram at the electric field plane showing the waveforms of the high frequency signals transmitted by the first kind of the conventional partially reflective surface antenna and by the partially reflective surface antenna according to the first preferred embodiment of the present invention.
Figure 4C:
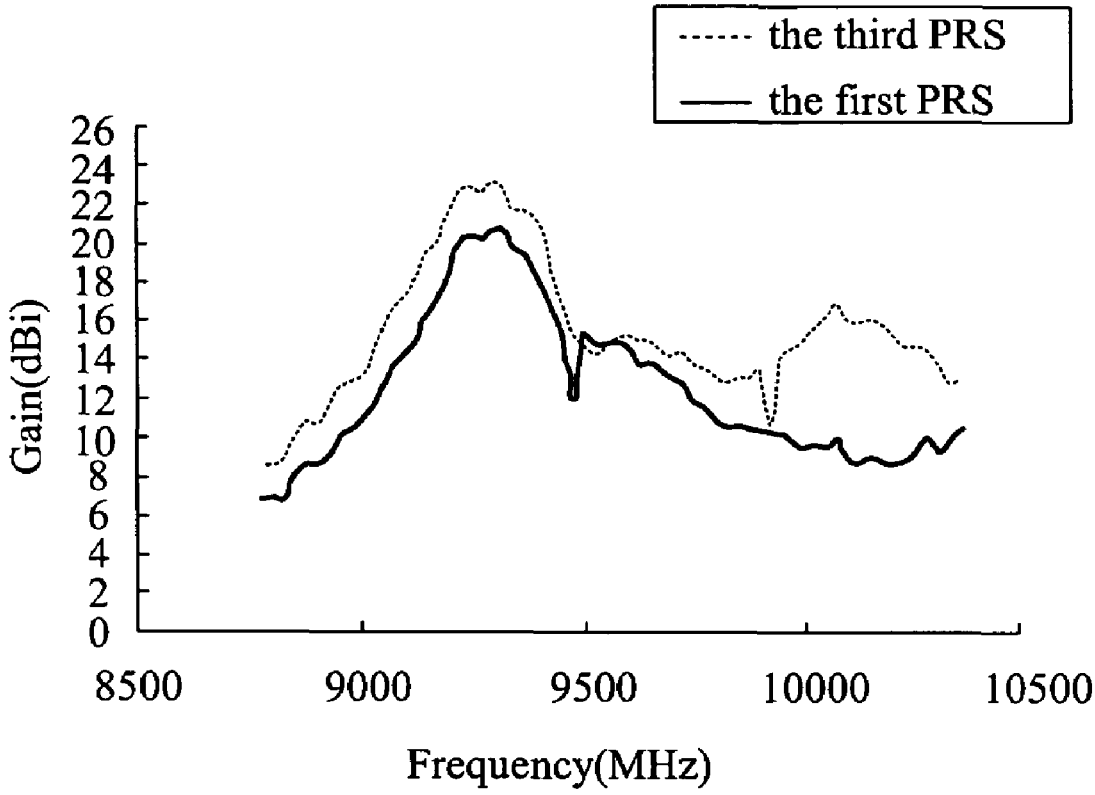
FIG. 4C is a schematic diagram showing the gain distribution curves of the first kind of the conventional partially reflective surface antenna and the partially reflective surface antenna according to the first preferred embodiment of the present invention.

In FIG. 4A, FIG. 4B, and FIG. 4C, the features of the high frequency signals transmitted by the partially reflective surface antenna according to the first preferred embodiment of the present invention are represented by the curve of "the third PRS". On the other hand, the features of the high frequency signals transmitted by the first kind of the conventional partially reflective surface antenna are represented by the curve of "the first PRS".

FIG. 4A is a waveform diagram at the magnetic field plane (H-plane) showing the waveforms of the high frequency signals (9.3 GHz) transmitted by the first kind of the conventional partially reflective surface antenna and by the partially reflective surface antenna according to the first preferred embodiment of the present invention. FIG. 4B is a waveform diagram at the electric field plane (E-plane) showing the high frequency signals (9.3 GHz) transmitted by the first kind of the conventional partially reflective surface antenna and by the partially reflective surface antenna according to the first preferred embodiment of the present invention.

Referring to FIG. 4A and FIG. 4B, the waveform of the third PRS curve is more centralized than the waveform of the first PRS curve, especially in the magnetic field plane (H-plane). Therefore, as compared to the high frequency signal transmitted by the first kind of the partially reflective surface antenna, the ratio of the side lobes portion of the high frequency signal transmitted by the partially reflective surface antenna according to the first preferred embodiment of the invention is lowered. Besides, the energy of the high frequency signal is more centralized into the main lobe portion of the high frequency signal. Thus, the distance that the high frequency signal can be transmitted is elongated, and the possibility of the high frequency signal being subjected to interference is minimized.

FIG. 4C is a schematic diagram showing the gain distribution curves of the first kind of the conventional partially reflective surface antenna and the partially reflective surface antenna according to the first preferred embodiment of the present invention. As shown in FIG. 4C, the frequencies of the maximum gain of the two partially reflective surface antennas are both close to 9300 MHz (9.3 GHz).

As also shown in FIG. 4C, in the whole frequency range between 8800 MHz and 10300 MHz, the gain curve (the third PRS) of the high frequency signal transmitted by the partially reflective surface antenna according to the first preferred embodiment of the present invention is always larger than the gain curve (the first PRS) of the high frequency signal transmitted by the first kind of the conventional partially reflective surface antenna. After executing certain calculating processes, the efficiency (the gain per area) of the partially reflective surface antenna according to the first preferred embodiment of the present invention is about 51%, which is the same as that the efficiency of the first kind of the conventional partially reflective surface antenna.

Moreover, the area of the reflective board of the first kind of the conventional partially reflective surface antenna is identical to the area covered by the first antenna array on the surface of the reflective board of the partially reflective surface antenna according to the first preferred embodiment of the present invention. Namely, the reflective board of the partially reflective surface antenna according to the first preferred embodiment of the present invention can be formed by adding the second antenna array with larger pitches surrounding the reflective board of the first kind of the conventional partially reflective surface antenna. Thus, by adding the area having the second antenna array on it, the side lobe portion of the high frequency signal transmitted by the partially reflective surface antenna according to the first preferred embodiment of the present invention is decreased, and the gain of the high frequency signal is increased. To be more specific, the wastages of the substrates and the conductive materials do not reduce the efficiency of the partially reflective antenna with its increased area, i.e. even with the reflective board having the larger area, the efficiency of the partially reflective surface antenna according the first preferred embodiment of the present invention does not change, it is maintained at 51%.

As shown in FIG. 4A and FIG. 4C, by adding the area having the second antenna array to the reflective board of the first kind of the conventional partially reflective surface antenna to form the reflective board of the partially reflective surface antenna according to the first preferred embodiment of the present invention, the ratio side lobe portion of the high frequency signal is obviously decreased, and the energy of the high frequency signal is more centralized in the main lobe portion thereof. Besides, the efficiency of the partially reflective surface antenna according to the first preferred embodiment of the present invention is maintained (still about 51%).

Later, the reflective board of the second kind of the partially reflective surface antenna is described, in order to prove that even with the reflective board having the same size, the partially reflective surface antenna of the present invention can still have better performance in transmitting high frequency signals (e.g. the efficiency of the partially reflective surface antenna), comparing to the second kind of the conventional partially reflective surface antenna.

Figure 5A:
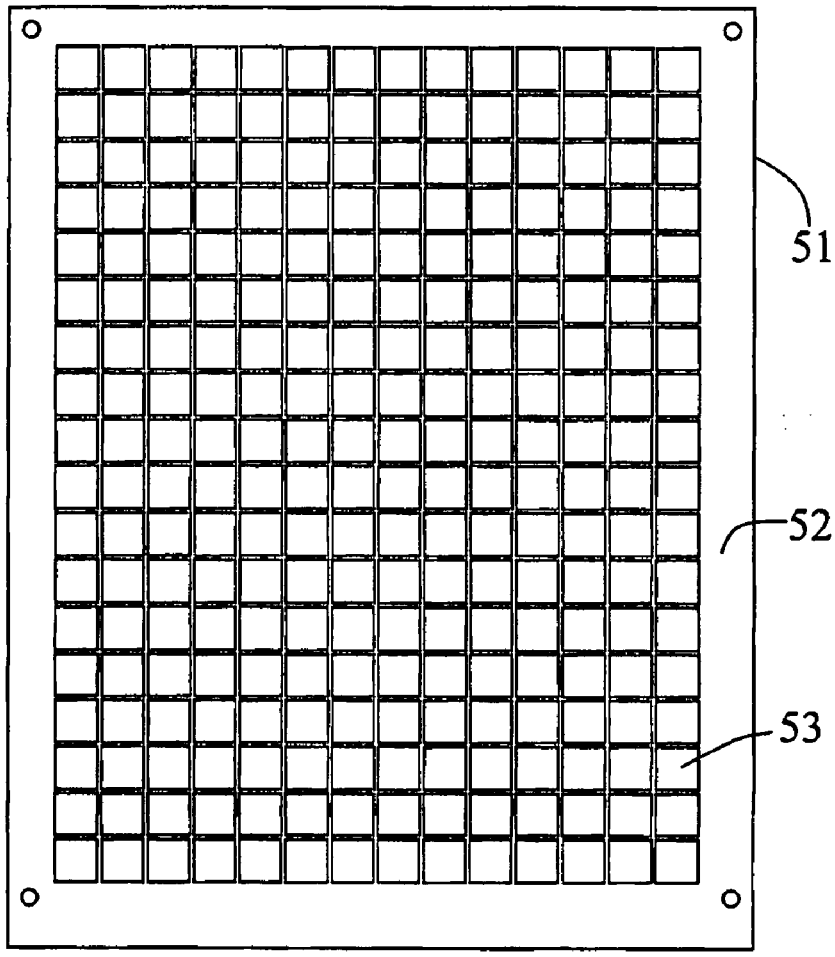
FIG.5A(Prior Art)
FIG. 5A is a schematic drawing of the reflective board of the second kind of the conventional partially reflective surface antenna.
Figure 5B:
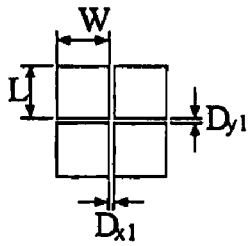
FIG.5B(Prior Art)
FIG. 5B is a schematic drawing showing the arrangements of the microstrip reflective units disposed on the surface of reflective board displayed in FIG. 5A.

FIG. 5A is a schematic drawing of the reflective board of the second kind of the conventional partially reflective surface antenna; FIG. 5B is a schematic drawing showing the arrangements of the microstrip reflective units disposed on the surface of reflective board displayed in FIG. 5A. The reflective board 51 is composed of a microwave substrate made of the FR-4 materials with the thickness of 0.8 mm. The length and width of the reflective board 51 are 19.4 cm and 16.9 cm, respectively. Thus, the surface area of the reflective board 51 is 327.86 $cm^2$. There is a plurality of microstrip reflective units 53 evenly disposed on the upper surface 52 of the reflective board 51, while both the length (L) and width (W) of the microstrip reflective unit 53 are 12 mm. The distance between two adjacent microstrip reflective units 53 in the x-axis direction and the y-axis direction are both 1.1 mm (Dx1=Dy1=1.1 mm).

After comparing the features (i.e. side lobe level ratio, gain, etc.) of the high frequency signal transmitted by the second kind of the conventional partially reflective surface antenna to those of the high frequency signal transmitted by the partially reflective surface antenna according to the first preferred embodiment of the invention, it is obvious that the high frequency signal transmitted by the partially reflective surface antenna according to the first preferred embodiment of the invention has lower side lobe level and better gain.

Figure 6A:
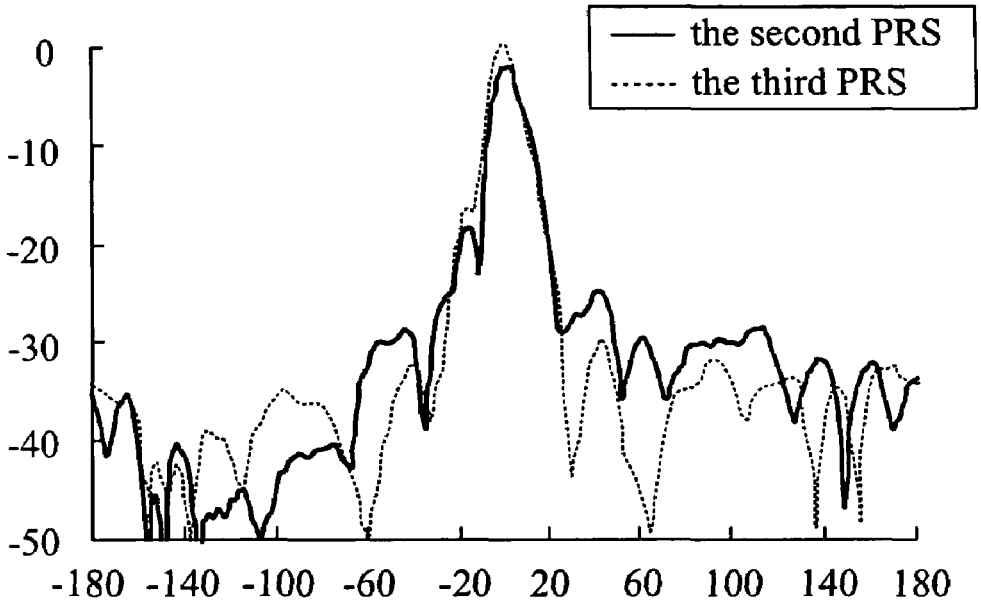
FIG. 6A is a waveform diagram at the magnetic field plane showing the waveforms of the high frequency signals transmitted by the second kind of the conventional partially reflective surface antenna and by the partially reflective surface antenna according to the first preferred embodiment of the present invention.
Figure 6B:
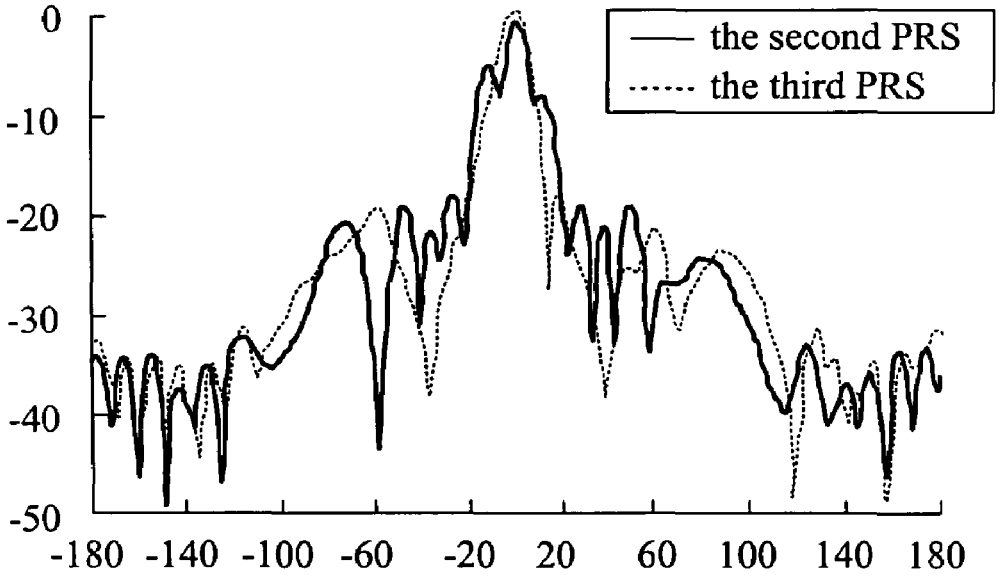
FIG. 6B is a waveform diagram at the electric field plane showing the waveforms of the high frequency signals transmitted by the second kind of the conventional partially reflective surface antenna and by the partially reflective surface antenna according to the first preferred embodiment of the present invention.
Figure 6C:
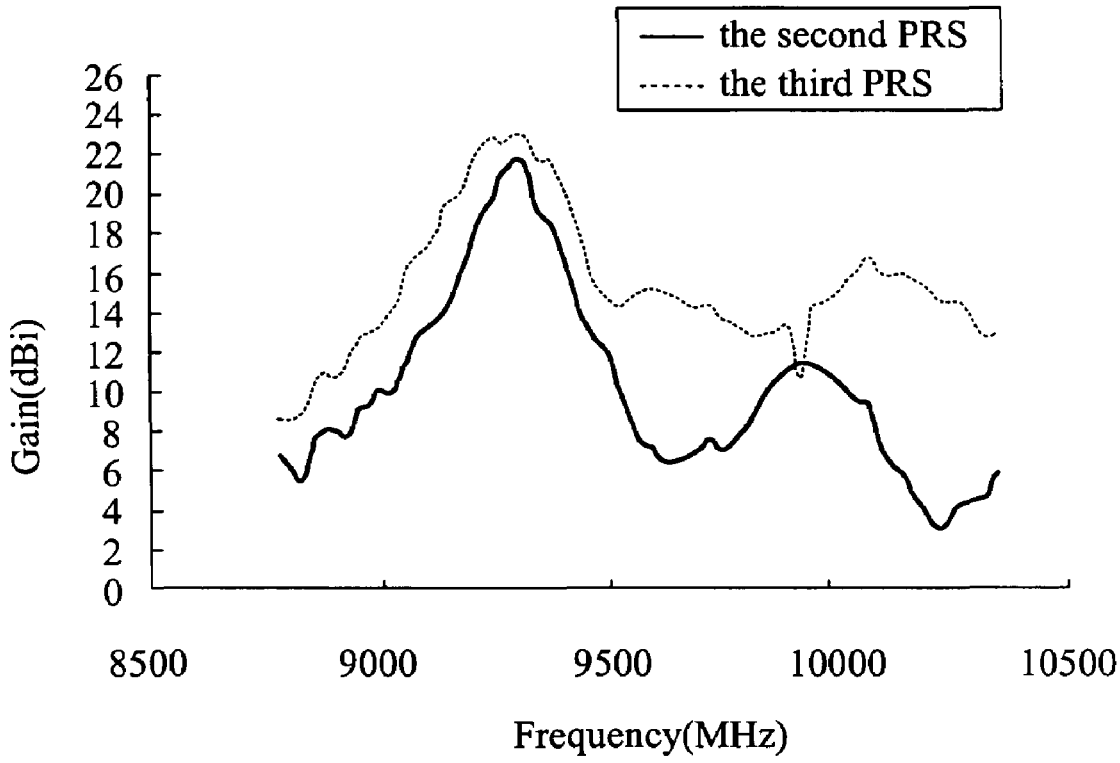
FIG. 6C is a schematic diagram showing the gain distribution curves of the second kind of the conventional partially reflective surface antenna and the partially reflective surface antenna according to the first preferred embodiment of the present invention.

In FIG. 6A, FIG. 6B, and FIG. 6C, the features of the high frequency signals transmitted by the partially reflective surface antenna according to the first preferred embodiment of the present invention are represented by the curve of "the third PRS". On the other hand, the features of the high frequency signals transmitted by the second kind of the conventional partially reflective surface antenna are represented by the curve of "the second PRS".

FIG. 6A is a waveform diagram at the magnetic field plane (H-plane) showing the waveforms of the high frequency signals (9.3 GHz) transmitted by the second kind of the conventional partially reflective surface antenna and by the partially reflective surface antenna according to the first preferred embodiment of the present invention. FIG. 6B is a waveform diagram at the electric field plane (E-plane) showing the high frequency signals (9.3 GHz) transmitted by the second kind of the conventional partially reflective surface antenna and by the partially reflective surface antenna according to the first preferred embodiment of the present invention.

With reference to FIG. 6A and FIG. 6B, the waveform of the third PRS curve is more centralized than the waveform of the second PRS curve, especially in the magnetic field plane (H-plane). Therefore, as compared to the high frequency signal transmitted by the second kind of the partially reflective surface antenna, the ratio of the side lobes portion of the high frequency signal transmitted by the partially reflective surface antenna according to the first preferred embodiment of the invention is lowered. Besides, the energy of the high frequency signal is more centralized into the main lobe portion of the high frequency signal. Thus, the distance that the high frequency signals can be transmitted is elongated, and the possibility of the high frequency signal being subjected to interference is minimized.

FIG. 6C is a schematic diagram showing the gain distribution curves of the second kind of the conventional partially reflective surface antenna and the partially reflective surface antenna according to the first preferred embodiment of the present invention. As shown in FIG. 6C, the frequencies of the maximum gain of this two partially reflective surface antenna are both close to 9300 MHz (9.3 GHz).

As also shown in FIG. 6C, in the whole frequency range between 8800 MHz and 10300 MHz, the gain curve (the third PRS) of the high frequency signal transmitted by the partially reflective surface antenna according to the first preferred embodiment of the present invention is always larger than the gain curve (the second PRS) of the high frequency signal transmitted by the second kind of the conventional partially reflective surface antenna.

After executing certain calculating processes, the efficiency (the gain per area) of the second kind of the partially reflective surface antenna is around 41%, which is far less than the efficiency of the partially reflective surface antenna according to the first preferred embodiment of the present invention (which is about 51%). That is, although the surface area of the reflective board of the partially reflective surface antenna according to the first preferred embodiment of the present invention (316.84 $cm^2$) is smaller than the surface area of the reflective board of the second kind of the conventional partially reflective surface antenna (327.86 $cm^2$), the gain curve (the third PRS) of the high frequency signal transmitted by the partially reflective surface antenna according to the first preferred embodiment of the present invention is still larger than the gain curve (the second PRS) of the high frequency signal transmitted by the second kind of the conventional partially reflective surface antenna.

As described above, referring to FIG. 6A through FIG. 6C, the gain of the partially reflective surface antenna according to the first preferred embodiment of the present invention is larger than the gain of the second kind of the conventional partially reflective surface antenna.

Figure 7A:
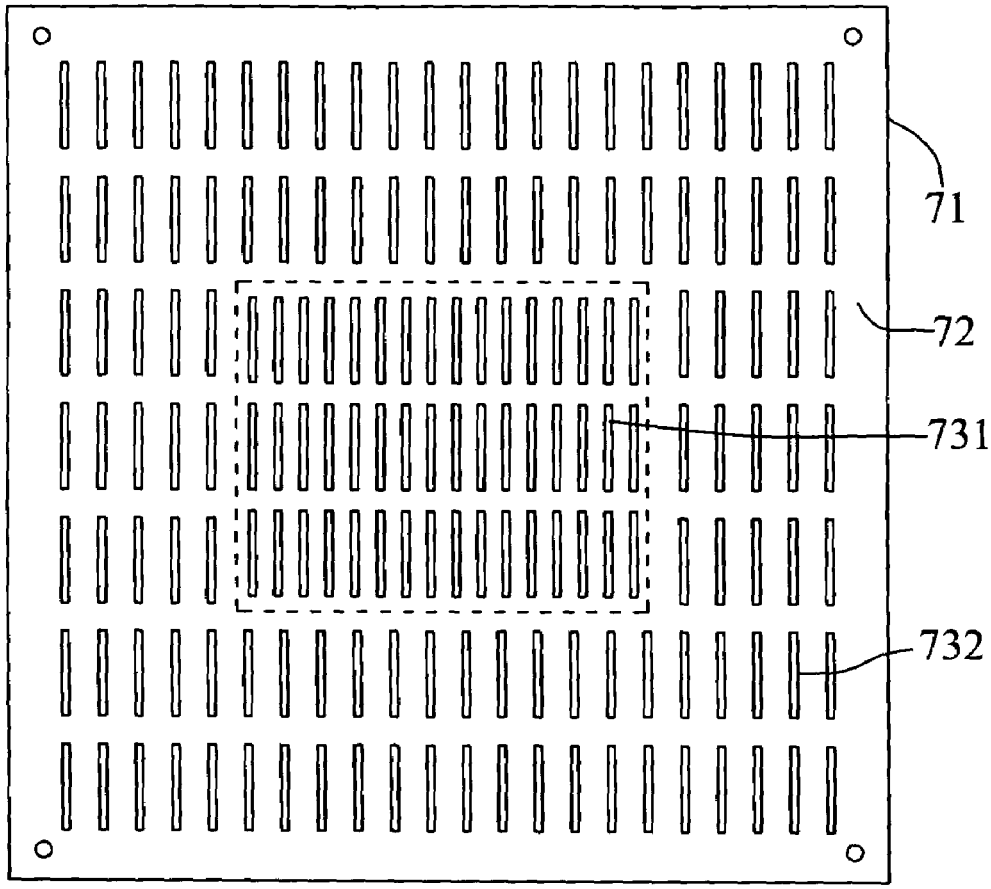
FIG. 7A is a schematic diagram of the reflective board of the partially reflective surface antenna according to the second preferred embodiment of the present invention.
Figure 7B:
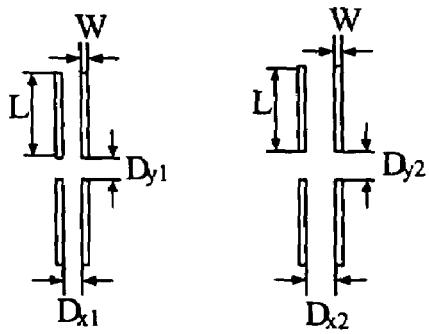
FIG. 7B is a schematic drawing showing the two kinds of the arrangements of the first antenna array and the second antenna array disposed on the surface of the reflective board of the partially reflective surface antenna according to the second preferred embodiment of the present invention.

FIG. 7A is a schematic diagram of the reflective board of the partially reflective surface antenna according to the second preferred embodiment of the present invention. FIG. 7B is a schematic drawing showing the two kinds of the arrangements of the first antenna array and the second antenna array disposed on the surface of the reflective board of the partially reflective surface antenna according to the second preferred embodiment of the present invention. The reflective board 71 is composed of a microwave substrate made of the FR-4 materials with a thickness of 0.8 mm; wherein the length and width of the reflective board 71 are 16.8 cm and 16.5 cm, respectively. There are two kinds of antenna array disposed on the upper surface 72 of the reflective board 71, i.e. the first antenna array and the second antenna array, with different pitches. In these two kinds of the antenna arrays, the length (L) and width (W) of the first microstrip reflective units 731 and the second microstrip reflective units 732 are 17.25 mm and 0.75 mm, respectively. However, the distance between two adjacent first microstrip reflective units 731 in X-axis direction is different from the distance between two neighboring second microstrip reflective units 732 in X-axis direction. Namely, the distances between two adjacent first microstrip reflective units 731 in the X-axis direction (Dx1) and in the Y-axis direction (Dy1) are both 0.75 mm (Dx1=Dy1=0.75 mm). However, the distance between two adjacent second microstrip reflective units 732 in the X-axis direction (Dx2) is 2.25 mm, while the distance between two adjacent second microstrip reflective units 732 in the Y-axis direction (Dy2) is 1.6 mm.

Besides, the 3-D structure of the partially reflective surface antenna according to the second preferred embodiment of the present invention is similar to the one shown in FIG. 2A, and its operation mechanism is the same as the partially reflective surface antenna according to the first preferred embodiment of the present invention. The differences between these two kinds of the partially reflective surface antenna of the present invention are the dimension of the reflective boards, the shape of the first microstrip reflective units and the second microstrip reflective units (i.e. square vs. rectangular), and the location of the rectangular notch on the substrate. Therefore, the 3-D structure of the partially reflective surface antenna according to the second embodiment of the present invention and the operational mechanism are omitted. As described above, after comparing the features (i.e. side lobe level ratio, gain, etc.) of the high frequency signal transmitted by the conventional partially reflective surface antenna to those of the high frequency signal transmitted by the partially reflective surface antenna according to the second preferred embodiment of the invention, it is obvious that the high frequency signal transmitted by the partially reflective surface antenna according to the second preferred embodiment of the invention has lower side lobe level and better gain.

Therefore, by having two different kinds of arrangement of the antenna array disposed on the surface of the reflective board, the partially reflective surface antenna of the present invention can reduce the energy ratio of the side lobe portion of the transmitted high frequency signals and centralize the energy of the transmitted high frequency signals into its main lobe portion, in order to elongate the distance that the high frequency signal can be transmitted and minimize the possibility of the high frequency signal being subjected to interference. Furthermore, the gain of the partially reflective surface antenna of the present invention is raised higher than that of the conventional partially reflective antenna, so the antenna module having the partially reflective surface antenna of the present invention can has optimum operation efficiency.

Although the present invention has been explained in relation to its preferred embodiment, it is to be understood that many other possible modifications and variations can be made without departing from the scope of the invention as hereinafter claimed.

What is claimed is:

1. A partially reflective surface antenna, adapting for receiving and transmitting a high frequency signal, which comprises:

a substrate having an upper surface, wherein the upper surface has a signal transmitting notch to receive and transmit the high frequency signal;

a reflective board for partially reflecting the high frequency signal, wherein a first antenna array and a second antenna array are disposed on the surface of the reflective board, and the first antenna array is surrounded by the second antenna array; and a plurality of supporting elements for supporting the reflective board on the upper surface of the substrate and maintaining a specific distance between the reflective board and the substrate;

wherein the first antenna array is composed of a plurality of first microstrip reflective units, the second antenna array is composed of a plurality of second microstrip reflective units; each of said first microstrip reflective units has a size equal to that of each of said second microstrip reflective units; and the distance between the first microstrip reflective units is smaller than the distance between the second microstrip reflective units.

2. The partially reflective surface antenna as claimed in claim 1, wherein the substrate is a microwave substrate made with the FR-4 materials.

3. The partially reflective surface antenna as claimed in claim 1, wherein the reflective board is a microwave substrate of the FR-4 materials.

4. The partially reflective surface antenna as claimed in claim 1, wherein the shape of the first microstrip reflective units is square.

5. The partially reflective surface antenna as claimed in claim 1, wherein the shape of the second microstrip reflective units is square.

6. The partially reflective surface antenna as claimed in claim 1, wherein the shape of the first microstrip reflective units is a strip-like shape.

7. The partially reflective surface antenna as claimed in claim 1, wherein the shape of the second microstrip reflective units is a strip-like shape.

8. The partially reflective surface antenna as claimed in claim 1, wherein the supporting elements are made of an insulating material.

9. The partially reflective surface antenna as claimed in claim 1, wherein the frequency range of the high frequency signal is between 9 GHz and 10 GHz.

10. The partially reflective surface antenna as claimed in claim 1, wherein the reflective board is a square board.

11. The partially reflective surface antenna as claimed in claim 1, wherein the specific distance between the reflective board and the substrate is one-half of the wavelength of the high frequency signal.

12. The partially reflective surface antenna as claimed in claim 1, wherein the shape of the signal transmitting notch is rectangular.

13. The partially reflective surface antenna as claimed in claim 1, wherein the signal transmitting notch is electrically connected to a coaxial cable.

* * * * *